US011072745B1

(12) United States Patent
Koseoglu

(10) Patent No.: US 11,072,745 B1
(45) Date of Patent: Jul. 27, 2021

(54) TWO-STAGE DELAYED COKING PROCESS TO PRODUCE ANODE GRADE COKE

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/852,702

(22) Filed: Apr. 20, 2020

(51) Int. Cl.
*C10B 57/02* (2006.01)
*C10B 55/00* (2006.01)
*C10B 57/04* (2006.01)

(52) U.S. Cl.
CPC ..... *C10B 57/02* (2013.01); *C10B 55/00* (2013.01); *C10B 57/045* (2013.01)

(58) Field of Classification Search
USPC ..... 208/50; 202/96, 105; 423/448, 460, 461
See application file for complete search history.

(56) References Cited

U.S. PATENT DOCUMENTS 2,899,376 A 8/1959 Krebs et al.
3,617,480 A 11/1971 Keel
3,684,697 A * 8/1972 Gamson ..... C10B 55/00 208/131
3,760,200 A 9/1973 Masaki et al.
3,769,200 A * 10/1973 Folkins et al. ..... C10B 57/045 208/53
3,959,115 A 5/1976 Hayashi et al.
4,235,700 A 11/1980 Metrailer
4,492,625 A 1/1985 Allan
4,547,298 A * 10/1985 Novak ..... C04B 14/36 166/294
4,551,232 A * 11/1985 Calderon ..... C10B 57/045 196/46
6,332,975 B1 * 12/2001 Abdel-Halim ..... C10G 55/04 208/131
7,604,731 B2 * 10/2009 Bhattacharyya ..... C10B 55/00 208/106
8,894,841 B2 11/2014 Koseoglu
9,909,068 B2 * 3/2018 Koseoglu ..... C10G 9/005
2013/0026069 A1 * 1/2013 Koseoglu ..... C10B 57/045 208/87
2015/0329784 A1 * 11/2015 Siskin ..... C10G 55/04 201/24
2016/0010005 A1 * 1/2016 Koseoglu ..... C10G 53/14 208/45

(Continued)

FOREIGN PATENT DOCUMENTS

CA 1203190 A 4/1986

*Primary Examiner* — Nina Bhat
(74) *Attorney, Agent, or Firm* — Dinsmore & Shohl LLP

(57) ABSTRACT

A delayed coking process for producing high grade coke comprising: introducing a hydrocarbon feedstock comprising asphaltenes to at least one fractionator to produce at least a bottoms fraction, an intermediate fraction and a light naphtha fraction: passing the bottoms fraction to a delayed coker unit furnace for heating to a predetermined coking temperature; passing the heated bottoms fraction to a first delayed coker unit to produce a first coke product and a first effluent substantially free of asphaltenes and comprising resins; and passing the first effluent to a second delayed coker unit to produce a second coke product comprising the high grade coke.

19 Claims, 1 Drawing Sheet

(56) References Cited

U.S. PATENT DOCUMENTS

| | | | | |
|---|---|---|---|---|
| 2016/0053189 | A1* | 2/2016 | Wang | C10G 45/28<br>208/100 |
| 2017/0284991 | A1* | 10/2017 | Song | C10B 55/00 |
| 2017/0306240 | A1* | 10/2017 | Koseoglu | C10G 21/003 |
| 2018/0187093 | A1* | 7/2018 | Choi | C10G 45/26 |

* cited by examiner

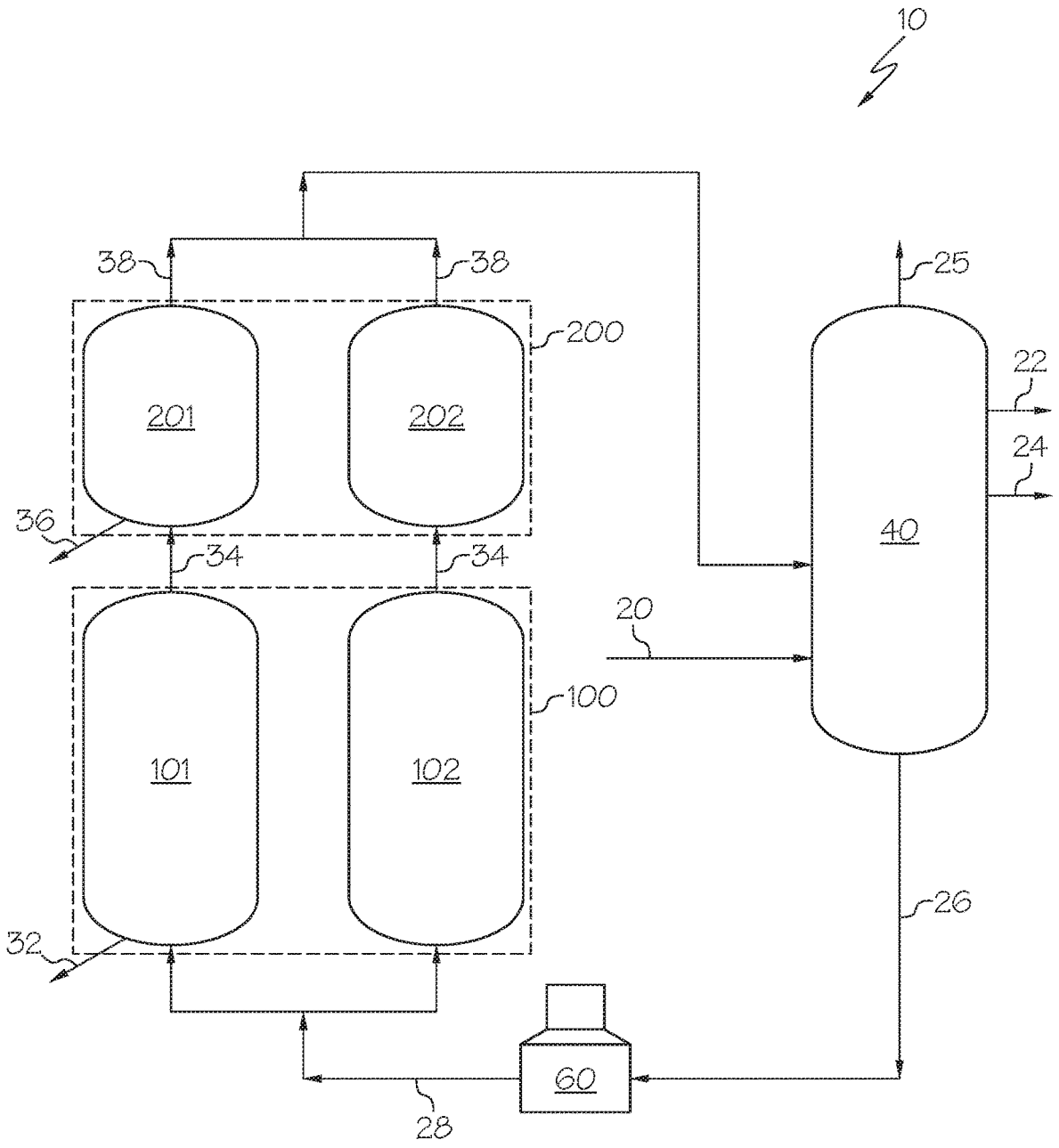
10
38
38
25
200
22
201
202
24
36
40
34
34
20
100
101
102
26
32
60
28

TWO-STAGE DELAYED COKING PROCESS TO PRODUCE ANODE GRADE COKE

TECHNICAL FIELD

Embodiments of the present disclosure generally relate to processes for producing high quality coke, and more specifically relate to processes, which utilize two stage delayed coking used to produce high grade coke.

BACKGROUND

Coke, specifically, high quality coke is utilized in various industrial applications. For example, high quality coke such as anode grade coke may be used in the aluminum industry and needle grade coke may be used in the steel industry. Coking units are conventional oil refinery processing units that convert low value residual oil, from the vacuum distillation column or the atmospheric distillation column into low molecular weight hydrocarbon gases, naphtha, light and heavy gas oils, and petroleum coke. The most commonly used coking unit is a delayed coker. In a basic delayed coking process, fresh feedstock is introduced into the lower part of a fractionator. The fractionator bottoms, which include heavy recycle material and fresh feedstock, are passed to a furnace and heated to a coking temperature. The hot feed then goes to a coke drum maintained at coking conditions where the feed is cracked to form light products while heavy free radical molecules form heavier polynuclear aromatic compounds, which are referred to as "coke." With a short residence time in the furnace, coking of the feed is thereby "delayed" until it is discharged into a coking drum. The volatile components are recovered as coker vapor and returned to the fractionator, and coke is deposited on the interior of the drum. When the coke drum is full of coke, the feed is switched to another drum and the full drum is cooled and emptied by conventional methods, such as by hydraulic means or by mechanical means.

That being said, residual oil is known to have a significant amount of asphaltenes and other impurities, which decreases the yield of high quality coke. Thus, conventional approaches use upstream high severity hydroprocessing (hydrotreating and hydrocracking) to purify the residual oil, such that the purified residual oil may be converted into high quality coke precursor, also called green coke, in the delayed coker. The green coke produced in the delayed coker may then be calcined to produce anode coke or needle coke. While the hydroprocessing upstream of the delayed coker yields green coke, it is very expensive due to its high pressure requirement.

SUMMARY

Accordingly, ongoing needs exist for improved methods and systems for producing high grade coke without utilizing expensive hydroprocessing.

Embodiments of the present disclosure meet this need by utilizing a two-stage delayed coking process is proposed. Without being limited by theory, the rate of coking for asphaltenes is approximately 10 times faster than that for resins due to molecular structures, solubility and other thermodynamic factors. Thus, the first delayed coker unit of the present embodiments produce fuel coke from the asphaltene, whereas the resin is substantially not coked in the first delayed coker unit, because of the slower resin coking rates. Consequently, the non-coked effluent of the first delayed coker unit will be sent to the second delayed coker unit for further delayed coking to produce anode grade coke. As the effluent includes resins, which contain less sulfur and metals, the resin may be coked to produce high grade coke e.g., the anode grade coke, needle coke, or both.

According to one or more embodiments, a delayed coking process for producing high grade coke is provided. The process comprises: introducing a hydrocarbon feedstock comprising asphaltenes to at least one fractionator to produce at least a bottoms fraction; passing the bottoms fraction to a delayed coker unit furnace for heating to a predetermined coking temperature; passing the heated bottoms fraction to a first delayed coker unit to produce a first coke product and a first effluent substantially free of asphaltenes and comprising resins; and passing the first effluent to a second delayed coker unit to produce a second coke product comprising the high grade coke.

Additional features and advantages of the described embodiments will be set forth in the detailed description, which follows, and in part will be readily apparent to those skilled in the art from that description or recognized by practicing the described embodiments, including the detailed description, which follows, the claims, as well as the appended drawing.

BRIEF DESCRIPTION OF THE DRAWINGS

FIG. 1 is a schematic depiction of the two-stage solvent delayed coking system in accordance with one or more embodiments of the present disclosure.

The embodiments set forth in the drawing are illustrative in nature and not intended to be limiting to the claims. Moreover, individual features of the drawing will be more fully apparent and understood in view of the detailed description.

DETAILED DESCRIPTION

Definitions

As used in the application, "residual oil" refers to the product of vacuum distillation or atmospheric distillation obtained in oil refineries. Atmospheric residue is defined as hydrocarbons boiling at a temperature of at least 350° C. and vacuum residue is defined as hydrocarbons boiling at a temperature of at least 450° C.

As used in the application, "anode coke", "fuel coke", and "needle coke" are defined by the ranges and properties provided in the following Table 1. As will be described further in the following examples, fuel grade coke, which generally has greater than 3.5 weight (wt.) % of sulfur and 650 ppm of metals (Ni+V), and anode coke, which generally has less than 3.5 wt. % sulfur and 450 ppm of metals, are often distinguished based on the sulfur and metals content in the respective cokes.

TABLE 1

| Property | Units | Fuel Coke | Anode Coke | Needle Coke |
|---|---|---|---|---|
| Bulk Density | Kilograms per cubic meter ($Kg/m^3$) | 880 | 720-800 | 670-720 |
| Sulfur | wt. % | 3.5-7.5 | 1.0-3.5 | 0.2-0.5 |
| Nitrogen | Parts per million by weight (Ppmw) | 6,000 | — | 50 |
| Nickel | ppmw | 500 | 200 | 7 max |
| Vanadium | ppmw | 150 | 350 | — |
| Volatile | wt. % | 12 | 0.5 | 0.5 |

TABLE 1-continued

| Property | Units | Fuel Coke | Anode Coke | Needle Coke |
|---|---|---|---|---|
| Combustible Material | | | | |
| Ash Content | wt. % | 0.35 | 0.40 | 0.1 |
| Moisture Content | | 8-12 | 0.3 | 0.1 |
| Hardgrove Grindability Index (HGI) | wt. % | 35-70 | 60-100 | — |
| Coefficient of thermal expansion, E + 7 | ° C. | — | — | 1-5 |

Referring to FIG. 1, embodiments of the present disclosure are directed to a delayed coking system 10 and a process for producing high grade coke. The system 10 includes a fractionator 40, a delayed coker furnace 60 downstream of the fractionator 40, and a first delayed coker unit 100 and a second delayed coker unit 200 downstream of the delayed coker furnace 60.

In operation as shown in FIG. 1, the process includes introducing a hydrocarbon feedstock 20 comprising asphaltenes to the fractionator 40. Various compositions are contemplated for the hydrocarbon feedstock 20, for example, any hydrocarbon mixture having a boiling point between 36° C. and 2000° C. In one or more embodiments, the hydrocarbon feedstock 20 may comprise an unrefined hydrocarbon source selected from the group consisting of crude oil, bitumen, tar sands, shale oils, coal liquefaction liquids, and combinations thereof. In further embodiments, the hydrocarbon feedstock 20 comprises residual oil, for example, atmospheric residue or vacuum residue as defined previously. In yet another embodiment, the hydrocarbon feedstock 20 comprises atmospheric residue.

As shown in the embodiment of FIG. 1, the hydrocarbon feedstock 20 may be fed to the bottom of the fractionator 40 and may be preheated. In one embodiment, the hydrocarbon feedstock 20 may be preheated prior to being fed to the fractionator 40. In one or more embodiments, the hydrocarbon feedstock 20 may be heated to a temperature of 430 to 530° C. The fractionator 40 may separate the hydrocarbon feedstock 20 into at least a bottoms fraction 26, an intermediate oil fraction 24, a light naphtha fraction 22, and a gas fraction 25. The gas fraction 25 may comprise hydrogen, ammonia, hydrogen sulfide, methane, ethane, propane, propylene, butanes, and butylenes. The light naphtha fraction 22 may comprise naphtha that boils in the range of 36 to 180° C., which is composed of paraffins, olefins, naphthenes and aromatics. The intermediate oil fraction 24 may comprise hydrocarbons that boil in the range of 180 to 350° C. and is composed of paraffins, olefins, naphthenes, and aromatics. The bottoms faction 26 may comprise hydrocarbons that boil above 250° C. and is composed of paraffins, olefins, naphthenes and aromatics.

Next, the bottoms fraction 26 may be passed to a delayed coker unit furnace 60 for heating to a predetermined coking temperature. While various coking temperatures are contemplated, the bottoms fraction 26 may be heated to a predetermined coking temperature in the range of 430° C. to 530° C., or from 480° C. to 530° C.

After heating, the heated bottoms fraction 28 is passed to a first delayed coker unit 100 to produce a first coke product 32 and a first effluent 34 comprising resins and is substantially free of asphaltenes. As used herein, "substantially free of asphaltenes" means that the first effluent has less than 1.0 wt % asphaltene, or less than 0.1 wt % asphaltene, or less than 0.01 wt. % asphaltene. Additionally, the first effluent 34 has less than 3.5 wt. % sulfur and less than 450 ppm of metals.

As shown in the embodiment of FIG. 1, the first delayed coker unit 100 may include at least two parallel drums 101, 102, which are operated in a swing mode. While not shown, it is contemplated that the first delayed coker unit 100 may include only one drum. In operation, when one coke drum is full of coke, the feed is switched to a fresh empty drum, and the full drum is cooled. The coke 32 remaining in the drums is typically cooled with water and then removed from the coke drum by conventional methods, for example, using hydraulic or mechanical techniques, or both, to dislodge the solid coke from the drum walls for recovery. The first coke product 32 comprises fuel grade coke, which has properties defined in Table 1 above.

Referring again to FIG. 1, the first effluent 34 is passed to a second delayed coker unit 200 to produce a second coke product 36 comprising the high grade coke. In one or more embodiments, the high grade coke of the second coke product 36 comprises anode coke, needle coke, or combinations thereof, the high grade coke product having properties defined in Table 1 above. Without being limited by theory, the first effluent 34, which includes resins, is substantially free of asphaltene, and has less sulfur and metals as described above, is a desirable feed to produce the second coke product 36 that meets the high grade coke specifications (e.g., anode coke or needle coke).

Like the first delayed coker unit 100, the second delayed coker unit 200 may include at least two parallel drums 201, 202, which are operated in a swing mode. While not shown, it is also contemplated that the second delayed coker unit 200 may include only one drum.

The first delayed coker unit 100 and the second delayed coker unit 200 may have similar or differing operating conditions. In one embodiment, the temperature of the first delayed coker unit 100, the second delayed coker unit 200, or both is from 480° C. to 530° C. Moreover, the pressure of the first delayed coker unit 100, the second delayed coker unit 200, or both may be from 1 to 7 bars.

Moreover, the delayed coker drums 101, 102, 201, and 202 may be sized and optimized based on the output specifications. In one embodiment, the drums 101, 102 of the first delayed coker unit 100 may have an interior volume at least 2 times larger than the drums 201, 202 of the second delayed coker unit 200. In further embodiments, the drums 101, 102 of the first delayed coker unit 100 may have an interior volume at least 5 times, or at least 10 times larger than the drums 201, 202 of the second delayed coker unit 200.

Various processing times are considered suitable for the first delayed coker unit 100 and the second delayed coker unit 200. In one embodiment, the first delayed coker unit 100 has a coking time from 1 to 2 hours, and the second delayed coker unit 200 has a coking time from 4 to 6 hours.

Referring again to FIG. 1, the second delayed coker unit 200 yields other products besides the second coke product 36, specifically, the second effluent 38 comprises: gases composed of hydrogen, ammonia, hydrogen sulfide, methane, ethane, propane, propylene, butanes, butylenes; and hydrocarbons that boil at 36° C. and are comprised of paraffins, olefins, naphthenes and aromatics with asphaltene content less than 1.0 wt. %, or less than 0.5 wt. %, or less than 0.1 wt. %. In one or more embodiments, the second effluent 38 is recycled back to the fractionator 40.

EXAMPLES

One or more of the previously described features will be further illustrated in the following example simulations.

Comparative Example 1

An atmospheric residue, composition of which is shown in Table 2, is delayed coked with a single conventional delayed coking unit at 499° C., 1 bar of pressure for 6 hours. The process yielded 18 wt. % of fuel grade coke. The fractionator was operated to obtain the bottoms fraction, an intermediate oil fraction, a light naphtha fraction, and a gas fraction in accordance with the boiling rate cuts defined above.

TABLE 2

| Property | Unit | Value |
|---|---|---|
| Sulfur | wt. % | 2.1 |
| Density | Kg/Lt | 0.962 |
| MCR | wt. % | 11.0 |
| SARA Analysis | | |
| Saturates | wt. % | 32.3 |
| Aromatics | wt. % | 43.7 |
| Resins | wt. % | 19.1 |
| Asphaltenes | wt. % | 4.8 |

Example 2

The same feedstock undergoes delayed coking in a two-stage delayed coking unit at 499° C., 1 bar of pressure for 2 hours in the first drum and 4 hours in the second drum. The process yielded 7 wt. % of fuel grade coke and 11 wt. % of anode grade coke.

It should now be understood that the various aspects of the delayed coking process and the system for producing the same are described and such aspects may be utilized in conjunction with various other aspects.

In a first aspect, a delayed coking process for producing high grade coke comprises: introducing a hydrocarbon feedstock comprising asphaltenes to at least one fractionator to produce at least a bottoms fraction; passing the bottoms fraction to a delayed coker unit furnace for heating to a predetermined coking temperature; passing the heated bottoms fraction to a first delayed coker unit to produce a first coke product and a first effluent substantially free of asphaltenes and comprising resins; and passing the first effluent to a second delayed coker unit to produce a second coke product comprising the high grade coke.

In a second aspect, the disclosure provides the process of the first aspect and further discloses that the hydrocarbon feedstock is preheated prior to being fed to the fractionator.

In a third aspect, which is in combination with any or all of the first and second aspects, the first coke product is deposited in the interior of at least one drum of the first delayed coking unit, and the second coke product is deposited in the interior of at least one drum of the second delayed coking unit.

In a fourth aspect, which is in combination with any or all of the first through third aspects, the first coke product comprises fuel grade coke.

In a fifth aspect, which is in combination with any or all of the first through fourth aspects, the second coke product comprises anode grade or needle coke.

In a sixth aspect, which is in combination with any or all of the first through fifth aspects, the temperature of the first delayed coker unit, the second delayed coker unit, or both is from 430° C. to 530° C.

In a seventh aspect, which is in combination with any or all of the first through sixth aspects, the pressure of the first delayed coker unit, the second delayed coker unit, or both is from 1 to 7 bars.

In an eighth aspect, which is in combination with any or all of the first through seventh aspects, the hydrocarbon feedstock is an unrefined hydrocarbon source selected from the group consisting of crude oil, bitumen, tar sands, shale oils, coal liquefaction liquids, and combinations thereof.

In a ninth aspect, which is in combination with any or all of the first through eighth aspects, the hydrocarbon feedstock comprises atmospheric residue or vacuum residue.

In a tenth aspect, which is in combination with any or all of the first through ninth aspects, the hydrocarbon feedstock is a mixture having a boiling point between 36° C. and 2000° C.

In an eleventh aspect, which is in combination with any or all of the first through tenth aspects, the first delayed coker unit, the second delayed coker unit, or both includes two drums operated in swing mode.

In a twelfth aspect, which is in combination with the eleventh aspect, the drums of the first delayed coker unit have an interior volume at least 2 times larger than the drums of the second delayed coker unit.

In a thirteenth aspect, which is in combination with any or all of the first through twelfth aspects, the first delayed coker unit has a coking time from 1 to 2 hours.

In a fourteenth aspect, which is in combination with any or all of the first through thirteenth aspects, the second delayed coker unit has a coking time from 4 to 6 hours.

In a fifteenth aspect, which is in combination with any or all of the first through fourteenth aspects, the second delayed coker unit produces a second effluent.

In a sixteenth aspect, which is in combination with the fifteenth aspect, the second effluent is recycled back to fractionator.

In a seventeenth aspect, which is in combination with any or all of the first through sixteenth aspects, the fractionator further produces a gas fraction, a light naphtha fraction, and an intermediate oil fraction.

In an eighteenth aspect, which is in combination with any or all of the first through seventeenth aspects, the bottoms fraction comprises hydrocarbons that boil above 250° C.

In a nineteenth aspect, which is in combination with any or all of the first through eighteenth aspects, the bottoms fraction comprises paraffins, olefins, naphthenes, and aromatics.

It should be apparent to those skilled in the art that various modifications and variations can be made to the described embodiments without departing from the spirit and scope of the claimed subject matter. Thus it is intended that the specification cover the modifications and variations of the various described embodiments provided such modifications and variations come within the scope of the appended claims and their equivalents.

Throughout this disclosure, ranges are provided. It is envisioned that each discrete value encompassed by the ranges are also included. Additionally, the ranges which may be formed by each discrete value encompassed by the explicitly disclosed ranges are equally envisioned.

What is claimed is:

1. A delayed coking process for producing high grade coke comprising:

introducing a hydrocarbon feedstock comprising asphaltenes to at least one fractionator to produce at least a bottoms fraction;

passing the bottoms fraction comprising asphaltenes to a delayed coker unit furnace for heating to a predetermined coking temperature;

passing the heated bottoms fraction to a first delayed coker unit to produce a first coke product and a first effluent, the first effluent substantially free of asphaltenes and comprising resins; and passing the first effluent to a second delayed coker unit to produce a second coke product comprising the high grade coke.

2. The delayed coking process of claim 1, wherein the hydrocarbon feedstock is preheated prior to being fed to the fractionator.

3. The delayed coking process of claim 1, wherein the first coke product is deposited in the interior of at least one drum of the first delayed coking unit, and the second coke product is deposited in the interior of at least one drum of the second delayed coking unit.

4. The delayed coking process of claim 1, which the first coke product comprises fuel grade coke.

5. The delayed coking process of claim 1, which the second coke product comprises anode grade or needle coke.

6. The delayed coking process of claim 1, wherein the temperature of the first delayed coker unit, the second delayed coker unit, or both is from 430° C. to 530° C.

7. The delayed coking process of claim 1, wherein the pressure of the first delayed coker unit, the second delayed coker unit, or both is from 1 to 7 bars.

8. The delayed coking process of claim 1, wherein the hydrocarbon feedstock is an unrefined hydrocarbon source selected from the group consisting of crude oil, bitumen, tar sands, shale oils, coal liquefaction liquids, and combinations thereof.

9. The delayed coking process of claim 1, wherein the hydrocarbon feedstock comprises atmospheric residue or vacuum residue.

10. The delayed coking process of claim 1, wherein the hydrocarbon feedstock is a mixture having a boiling point between 36° C. and 2000° C.

11. The delayed coking process of claim 1, wherein the first delayed coker unit, the second delayed coker unit, or both includes two drums operated in swing mode.

12. The delayed coking process of claim 11, wherein the drums of the first delayed coker unit have an interior volume at least 2 times larger than the drums of the second delayed coker unit.

13. The delayed coking process of claim 1, wherein the first delayed coker unit has a coking time from 1 to 2 hours.

14. The delayed coking process of claim 1, wherein the second delayed coker unit has a coking time from 4 to 6 hours.

15. The delayed coking process of claim 1, wherein the second delayed coker unit produces a second effluent.

16. The delayed coking process of claim 15, wherein the second effluent is recycled back to fractionator.

17. The delayed coking process of claim 1, wherein the fractionator further produces a gas fraction, a light naphtha fraction, and an intermediate oil fraction.

18. The delayed coking process of claim 1, wherein the bottoms fraction comprises hydrocarbons that boil above 250° C.

19. The delayed coking process of claim 18, wherein the bottoms fraction comprises paraffins, olefins, naphthenes, and aromatics.

* * * * *